United States Patent [19]

Kusumoto

[11] Patent Number: 4,958,192

[45] Date of Patent: Sep. 18, 1990

[54] IMAGE FORMING APPARATUS HAVING PLURAL DEVELOPING UNITS AND A DEVICE FOR SELECTING A PREDETERMINED DEVELOPING UNIT

[75] Inventor: Keiji Kusumoto, Osaka, Japan

[73] Assignee: Minolta Camera Kabushiki Kaisha, Osaka, Japan

[21] Appl. No.: 202,494

[22] Filed: Jun. 7, 1988

[30] Foreign Application Priority Data

Jun. 8, 1987 [JP] Japan ..... 62-142931

[51] Int. Cl.[5] ..... G03G 15/06

[52] U.S. Cl. ..... 355/245; 355/326

[58] Field of Search ..... 355/245, 326, 327, 328

[56] References Cited

U.S. PATENT DOCUMENTS

| | | | |
|---|---|---|---|
| 3,960,445 | 6/1976 | Drawe | 355/326 |
| 4,222,660 | 9/1980 | Furuichi et al. | 355/311 |
| 4,416,533 | 11/1983 | Tokunaga et al. | 355/326 X |
| 4,579,443 | 4/1986 | Abuyama et al. | 355/326 X |
| 4,619,514 | 10/1986 | Ide | 355/327 X |
| 4,720,730 | 1/1988 | Ito | 355/208 |

FOREIGN PATENT DOCUMENTS 60-230168 11/1985 Japan .

*Primary Examiner*—Fred L. Braun

*Attorney, Agent, or Firm*—Burns, Doane, Swecker & Mathis

[57] ABSTRACT

An image forming apparatus is provided and includes first and second developing units for developing a latent image which is formed on a photoconductor provided with the image forming apparatus. The control panel provides an arrangement for selecting either one of the first and second developing units for operation in the image forming apparatus. Additionally, the selection arrangement is provided so as to select the first developing unit if the developers, utilized in the first and second developing units, are of the same kind. If the developers of the first and second developing units are different from one another, the selection arrangement permits the selection of the second developing unit.

13 Claims, 7 Drawing Sheets

IMAGE FORMING APPARATUS HAVING PLURAL DEVELOPING UNITS AND A DEVICE FOR SELECTING A PREDETERMINED DEVELOPING UNIT

BACKGROUND OF THE INVENTION

1. Field of the Invention

The present invention relates to an image forming apparatus such as a copy machine, a printer or the like which provides at least two developing means.

2. Description of the Prior Art

A copy machine having plural developing units being settable thereinto has been well known. In such a copy machine, each developing unit provides a signal means for identifying a color of toner contained therein and, due to the signal means, each color of toner of respective developing units having been set in the copy machine can be detected. When a desired color is designated upon copying, a developing unit having the desired color of toner is automatically selected to develop an electrostatic latent image of a document formed on a photoconductor drum with the toner of desired color.

In such a multi-color copy machine, the black developing unit, namely the developing unit containing black toner is assigned as the standard one to be equipped in each copy machine since most of documents to be copied are black and white. If a copy machine has an upper and a lower developing stages, the black developing unit is usually set at the lower developing stage as the standard one and another developing unit is interchangeably set at the upper developing stage.

Assuming that two developing units of the same color such as black are set at the upper and lower stages, respectively, the amount of consumption of toner of the lower developing unit becomes much more than that of the upper one since the frequency in use of the former is higher than that of the latter. Accordingly, when the composite copy of two colors is repeated after the upper one has been exchanged to another developing unit of a different color, the lower developing unit is apt to become into a state of toner empty which requests to replenish with toner. This is inconvenient for the user and is applied to the case of an image forming apparatus other than the copy machine which provides plural developing means.

SUMMARY OF THE INVENTION

One object of the present invention is to provide an image forming apparatus wherein the toner consumption of the standard developing unit can be decreased as far as at least one developing unit having the same color to that of the standard one is set.

Another object of the present invention is to provide an image forming apparatus wherein the priority given to the standard developing unit is cancelled if at least one developing unit having the same color to that of the standard one is set.

A further object of the present invention is to provide an image forming apparatus having plural stages for setting developing units to each of which individual priority in use is given wherein the order of priorities is neglected as far as at least two developing units of the same color are set therein.

In order to accomplish these objects, according to the present invention, there is provided an image forming apparatus comprising a photoconductor, first developing means for developing a latent image formed on the photoconductor with first developer, second developing means for developing a latent image formed on the photoconductor with second developer and selection means for selecting said first developing means if both of the first and second developers are of a kind and selecting said second developing means if the first developer and the second one are different from each other when a power supply source for the image forming apparatus is switched on.

The present invention can be applied to an image forming apparatus having entry means for entering conditions for forming an image.

In this case, if no image forming operation is started within a predetermined time period after said conditions for forming an image were entered, the selection means selects the first developing menas as far as both of the first and second developers are of a kind while it selects the second developing unit as usual as far as the first and second developers are different from each other.

Also, the present invention can be applied to when an image forming operation has been completed. Namely, the selection means selects either one of the first and second developing units according to relation between the first and second developers.

BRIEF DESCRIPTION OF DRAWINGS

These and other objects and features of the present invention will become more apparent when the preferred embodiment of the present invention is described in detail with reference of accompanied drawings in that.

DESCRIPTION OF THE PREFERRED EMBODIMENT

In the preferred embodiment, the present invention is applied to a copy machine.

Figure 2:
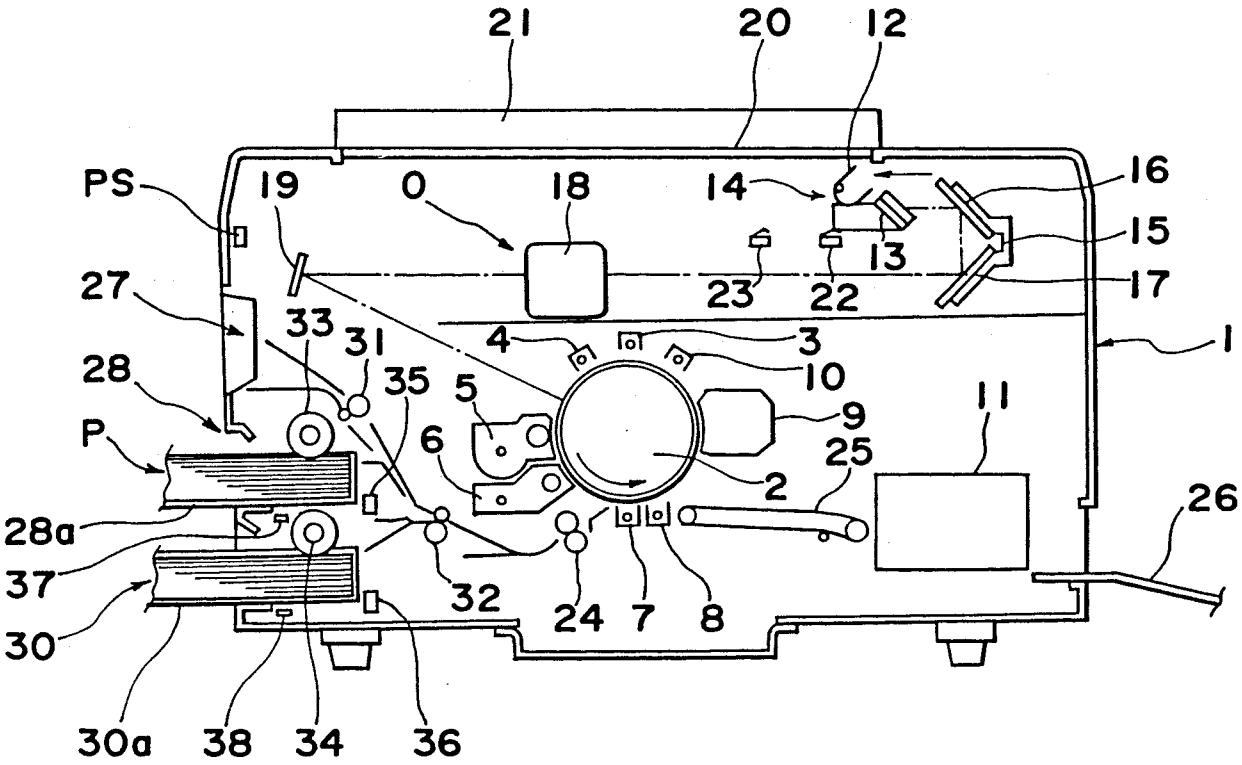
FIG. 2 is a schematic cross-sectional view of a copy machine according to the present invention.

As shown in FIG. 2, a photo-conductive drum 2 is supported rotatably in the center portion of a copy machine, which is driven to rotate in an anti-clockwise direction by a main motor (not shown). An electrifying charger (main charger) 3, an inter-image eraser 4 for erasing charges on a range of the drum where no document image is formed, upper and lower developing units 5, 6, a transferring charger 7, a separating charger 8, a cleaner 9 and a main eraser 10 are arranged around the drum 2 in a direction of rotation thereof. A scanning optical system 0 is arranged above the drum 2 and, on the left side thereof, a paper supplying system P is arranged. On the right side thereof, a fixing apparatus 11 is arranged.

The copy machine 1 is connected to a power source when a power switch PS is switched on.

The scanning optical system 0 is comprised of a scanning unit 14 in which a light source 12 for illuminating a document through a slit and first movable mirror 13 are assembled, second and third mirrors 16 and 17 which are supported by a common holder 15, lens assembly 18 and a fixed mirror 19. A document to be copied is set on a glass platen 20 and covered by a document cover 21. A document scale (not shown) is arranged along an edge of the glass platen on the starting side of scan and a reference pattern (not shown) for detecting a density for developing is provided on the lower surface of the document scale.

When a scan is started by driving a scanning motor (not shown), an image of the reference pattern and a document image are exposed onto a range of the drum 2 which is electrified by the main charger 3 and, accordingly, latent images of the reference pattern and the document are formed on the drum 2.

The scanning velocity V of the scanning unit 14 is controlled at ($V_{O/m}$) assuming that the peripheral rotation speed of the drum 2 is equal to $V_O$ and a magnification of copy at that time is set at m, and the second and third mirrors 16 and 17 are moved at a velocity of ($V_{O/2m}$).

In order to detect positions of the scanning unit 14, a position switch 22 and a timing switch 23 are provided. The position switch 22 detects that the scanning unit 14 has returned to a predetermined standard position and outputs a signal indicating it to a control circuit of the copy machine (See FIG. 6). The timing switch 23 is arranged at a suitable position for detecting a timing when the scanning unit 14 moves by a predetermined distance from the starting position thereof and outputs a timing signal to the control circuit at that timing in order to drive a pair of timing rollers 24 for feeding a copy paper.

The latent image formed on the drum 2 is developed with toner which is supplied by either one of the first and second developing units 5 and 6. The formed toner image is transferred onto a copy paper fed by the pair of timing rollers 24 by energizing the transferring charger 7. The copy paper onto which the toner image is transferred is separated from the surface of the drum 2 by the separating charger 8. Then, the copy paper is conveyed to the fixing device 11 by a conveyer belt 25. The fixing device 11 fixes the toner image by heating and discharges the copy paper on a tray 26.

Toner remaining on the drum 2 is removed by the cleaner 9 and charge remaining thereon is erased by the main eraser 10 which is maintained to be turned on as far as the main motor is driven.

The density of the toner image of the reference pattern is measured with use of an LED (light emitting diode) and a photo-sensor (not shown) before removing remaining toner by the cleaner 9. The measured density is compared with a predetermined standard value. According to the result of the comparison, the amount of supply of toner by the first or second developing unit is controlled.

The paper supplying system P has a manual inserting means 27, first paper supplying unit 28 providing a cassette **28*a* and second paper supplying unit 30 providing cassette 30*a***.

When a blank paper is inserted manually into the manual inserting means 27, it is fed by a roller 31, an intermediate roller 32 to the pair of timing rollers 24. A blank paper contained in the first or second cassette **28*a* or 30*a* is fed by first or second feeding roller 33 or 34 and the intermediate roller 32 to the pair of timing rollers 24**.

Each of rollers 24, 31, 32, 33 and 34 is engageable via clutch means, to a driving system (not shown) including the main motor. Accordingly, each roller is driven by the driving system when the corresponding clutch means is switched on. Paper size detection sensors 35 and 36 for detecting each size of blank papers contained in the cassette **28*a* and 30*a* and sensors 37 and 38 for detecting that respective cassettes become empty are arranged near the cassette 28*a* and 30*a***, respectively.

Figure 3:
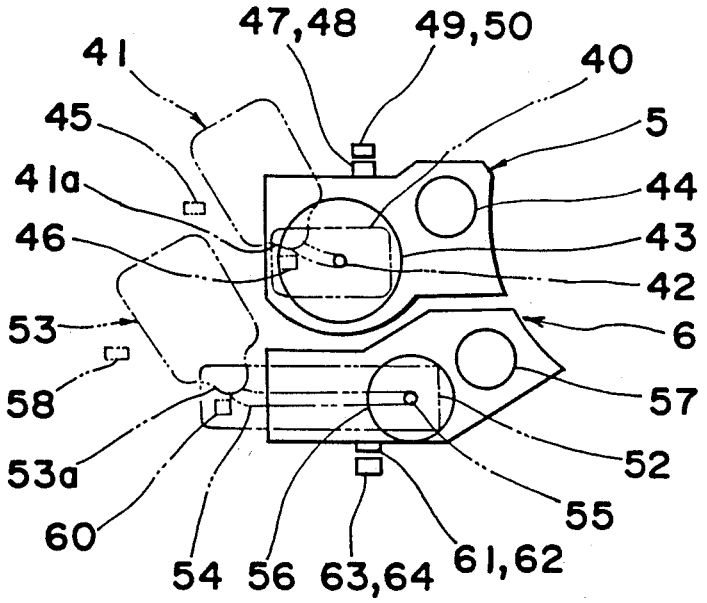
FIG. 3 is a schematic side view for showing developing units according to the preferred embodiment of the present invention.
Figure 4:
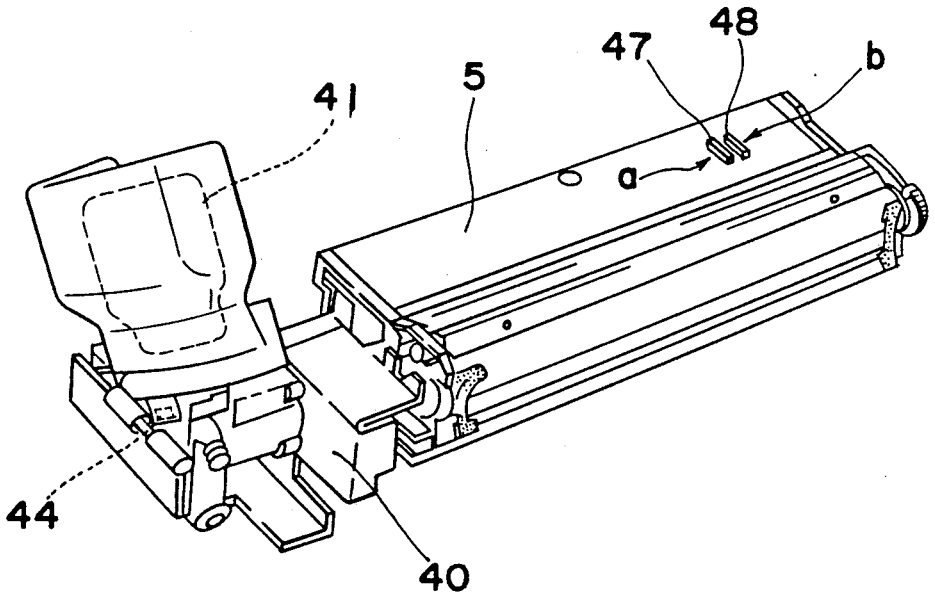
FIG. 4 is a perspective view of the developing unit.

FIG. 3 shows side elevational views of the upper and lower developing units 5 and 6 and FIG. 4 shows a perspective view of the former.

These developing units 5 and 6 are interchangeably set in the copy machine. Though setting structures of them are not shown explicitly, those skilled in the art can easily understand those structures.

At first, the structure of the upper developing unit 5 is explained referring to FIG. 3 and FIG. 4.

A bracket 40 is fixed on an end in the length-wise direction of the upper developing unit 5. A toner replenishing bottle 41 for replenishing toner into the upper developing unit 5 is detachably mounted on the bracket 40. The toner replenishing mouth **41*a* of the bottle 41 is connected to an end of a toner transporting tube 42 extending in the upper developing unit 5** in the length-wise direction thereof.

The replenishing amount of toner from the toner replenishing bottle 41 is determined by controlling the number of revolutions of the bottle which is driven by a toner replenishing motor (not shown).

Namely, when the bottle 41 is rotated around the center axis thereof by the toner replenishing motor, the toner replenishing mouth **41*a* is opened and closed according to each rotation thereof and, accordingly, the replenishing amount of toner from the bottle 41 is controlled so as to be proportional to the number of revolutions of the toner. The latter is determined in accordance with the result of comparison of the measured density with the standard value as mentioned above. The toner replenished from the bottle 41 is supplied into the upper developing unit 5 through the transportation tube 42**.

The toner supplied into the unit 5 is mixed with magnetic carrier priorly contained in the unit 5 by rotating a bucket roller 43 with mixing blades. This bucket roller 43 is driven by a developing motor (not shown) which is mounted on the other end of the unit 5. The toner mixed with magnetic carrier is supplied to the surface of the drum by a developing sleeve 44 which is also driven to rotate by the developing motor. The latent image formed on the drum 2 is visualized by the supplied toner, while the magnetic carrier is collected into the unit and is used repeatedly. Besides, a bias voltage is applied to the developing sleeve from a power source therefor upon developing a latent image. If it is not applied thereto, the latent image, is not developed by the developing unit even if the bucket roller 43 and the sleeve roller 44 are driven.

As is shown in FIG. 3, a bottle sensor 45 for detecting whether or not a toner replenishing bottle is mounted on the bracket 40 is arranged near the mount position thereof and a bottle empty sensor 46 for detecting an empty state of the bottle wherein toner has been consumed completely is arranged near the toner replenishing mouth 41a of the bottle mounted on the bracket 40. The bottle sensor 45 outputs a signal of high level as far as the bottle 41 is mounted on the bracket 40. Also, the bottle empty sensor 46 outputs a signal of high level as far as toner remains in the bottle. As shown in FIG. 4 clearly, two positions "a" and "b" are predetermined on the upper surface of the upper developing unit 5 in order to fix magnets for identifying a color of toner contained in the developing unit 5. In the example shown in FIG. 4, two magnets 47 and 48 are fixed at respective positions "a" and "b". Each existence of these magnets is detected by first and second reed switches 49 and 50 which are arranged above the positions "a" and "b", respectively, as shown in FIG. 3.

As shown in the following table, each toner color is identified from each combination of ON, OFF states of the first and second reed switches 49 and 50.

| First reed switch 49 | Second reed switch 50 | Toner color |
|---|---|---|
| ON | ON | Black |
| ON | OFF | Red |
| OFF | ON | Yellow |
| OFF | OFF | Blue |

On the other hand, the lower developing unit 6 provides similar structures to those of the upper developing unit 5. However, they are modified in order to arrange the lower developing unit 6 compactly under the upper one 5. Namely, a bracket 52 for mounting a toner replenishing bottle 53 is formed elongated rearwardly. Therefore, the toner replenishing bottle 53 can be mounted without interference with the upper developing unit 5. Further, magnets 61 and 62 are fixed at positions predetermined on the lower surface of the lower developing unit 6 and, accordingly, first and second reed switches 63 and 64 for detecting magnets 61 and 62 are arranged beneath the lower developing unit 6. Structures other than the mentioned above are substantially same to those of the upper developing unit 5. Namely, toner in the replenishing bottle 53 is supplied from the mouth 53a to a transporting tube 54 and the toner fed into the lower developing unit 6 through a transporting tube 55 is mixed with magnetic carrier according to rotation of a bucket roller 56 and the toner mixed with magnetic carrier is supplied to the surface of the drum 2 by a developing sleeve 57 when it is energized and rotated. A bottle sensor 58 and a bottle empty sensor 60 are also arranged near the replenishing bottle 53 and the mouth 53a thereof, respectively.

The lower developing unit 6 is used priorly as the standard one. Namely, black toner is replenished thereinto in order to copy a document with black toner.

If the user wishes to copy with toner of another color, the upper developing unit 5 is designated. If the color of toner contained in the present upper developing unit 5 is different from the desired color, the present developing unit 5 is exchanged with another developing unit containing toner of the desired color.

It is to be noted that the term "developing unit" includes the replenishing bottle to be mounted thereon.

Figure 5:
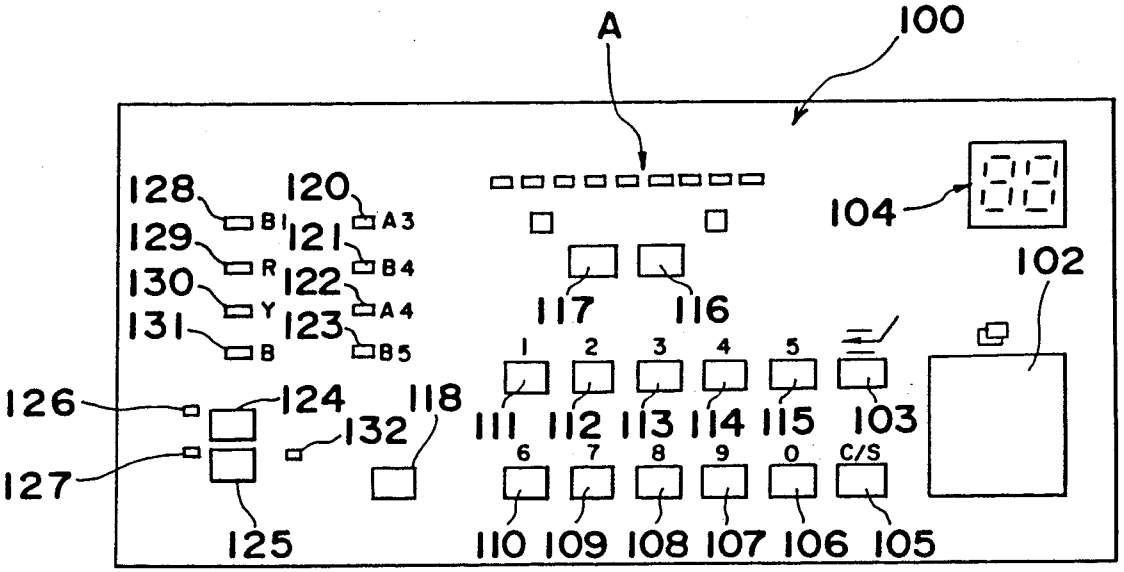
FIG. 5 is a plan view of an operational panel according to the preferred embodiment of the present invention.

FIG. 5 shows an operation panel 100 which is arranged on the upper front surface of the copy machine.

On the operation panel 100, the following elements are arranged:

a print key 102 for starting a copying operation; an interruption key 103; a digital display 104 for indicating the number of copies; a clear/stop key 105 for suspending a copy operation and for resetting the digital display 104; ten keys from 106 to 115 for setting the number of copies on the digital display 104;

an up key 116 and a down key 117 for increasing and decreasing the exposure amount by the light source, respectively;

a group A of LEDs for indicating the exposure amount selected presently;

a paper size selection key 118 for selecting or designating either one of the first and second paper supply units 28 and 30;

LEDs from 120 to 123 for indicating the paper size selected presently;

first and second developing unit selection keys 124 and 125 for selecting the upper and lower developing units 5 and 6, respectively;

two LEDs 126 and 127 for indicating the selected or designated developing unit 5 or 6 respectively;

four LEDs from 128 to 131 each for indicating respective color of toner contained in the selected developing unit; and one LED 132 for indicating that the bottle of the selected developing unit is empty.

If the color of toner of the upper developing unit 5 is different from that of the lower one, LED 127 for indicating black color of toner is turned on just after the power switch PS is switched on or when the copy machine is reset automatically.

On the contrary, if the color of toner of the upper developing unit 5 is same to that of the lower one and if it is black, LED 126 for indicating the upper one 5 and LED 128 are turned on under the same condition mentioned above. If the color is same but it is not black, either one of LEDs from 129 to 131 is turned on corresponding to the color of toner of the present upper developing unit 5.

Figure 6:
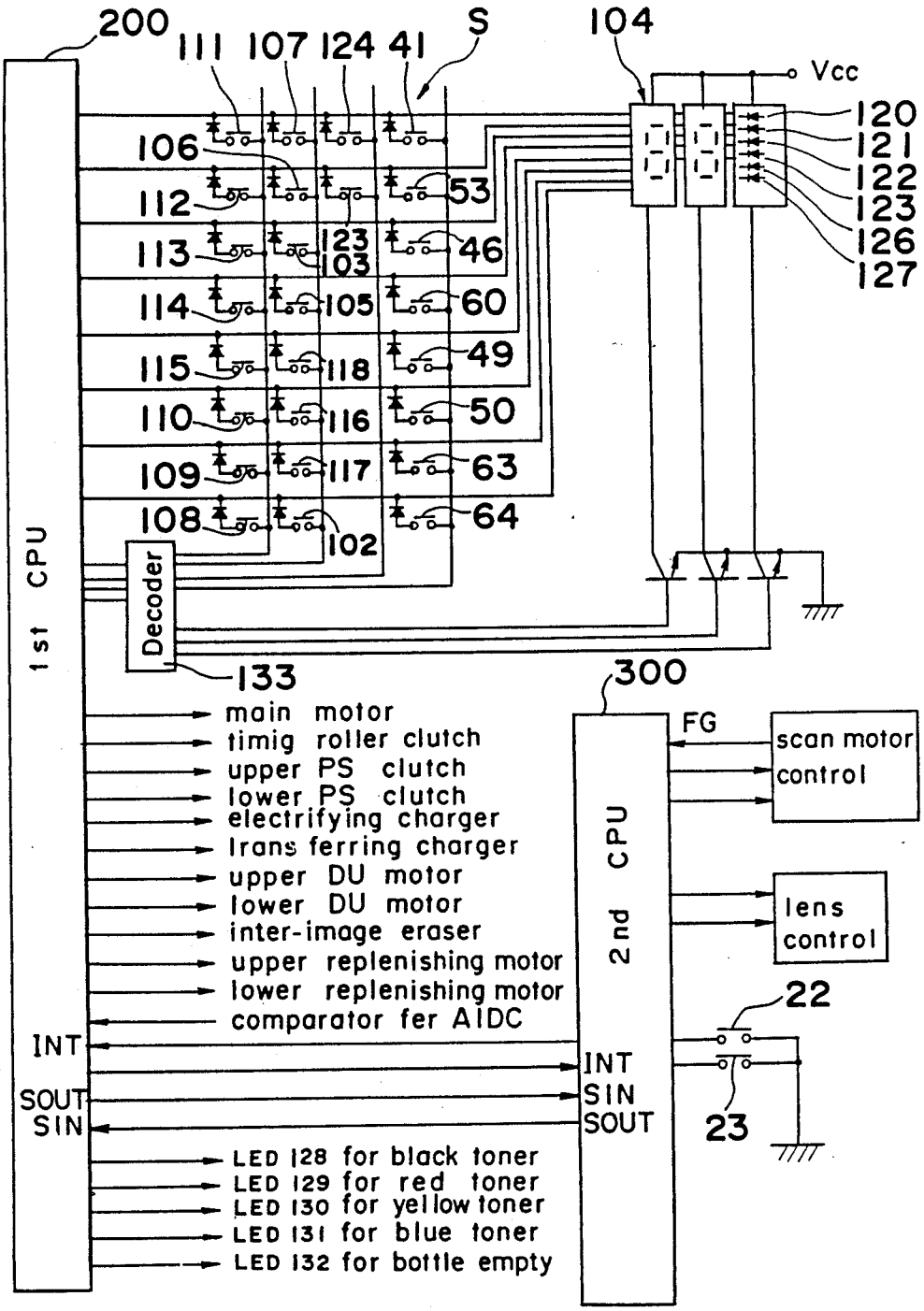
FIG. 6 is a block diagram showing control circuits for controlling the copy machine according to the present invention.

FIG. 6 shows a control circuit of the copy machine 1.

The control circuit includes first and second central processing units (CPUs) 200 and 300.

A switch matrix S is connected to the first CPU 200. The switch matrix S includes, as matrix elements, various keys on the operation panel, upper and lower bottle sensors 41 and 53, upper and lower bottle empty sensors 46 and 60, reed switches 49, 50, 63, 64 for identifying respective color of toner of each developing unit and the like. The first CPU 200 controls the main motor, various roller clutches and various LEDs in accordance with operations of individual keys and actions of individual sensors.

On the other hand, the second CPU 300 is provided for controlling the optical scanning system 0. The standard position switch 22 and the timing switch 23 are connected to the second CPU 300. Further, the same is connected to the first CPU 200 with some signal lines in order to synchronize both of the first and second CPUs with each other.

Figure 7:
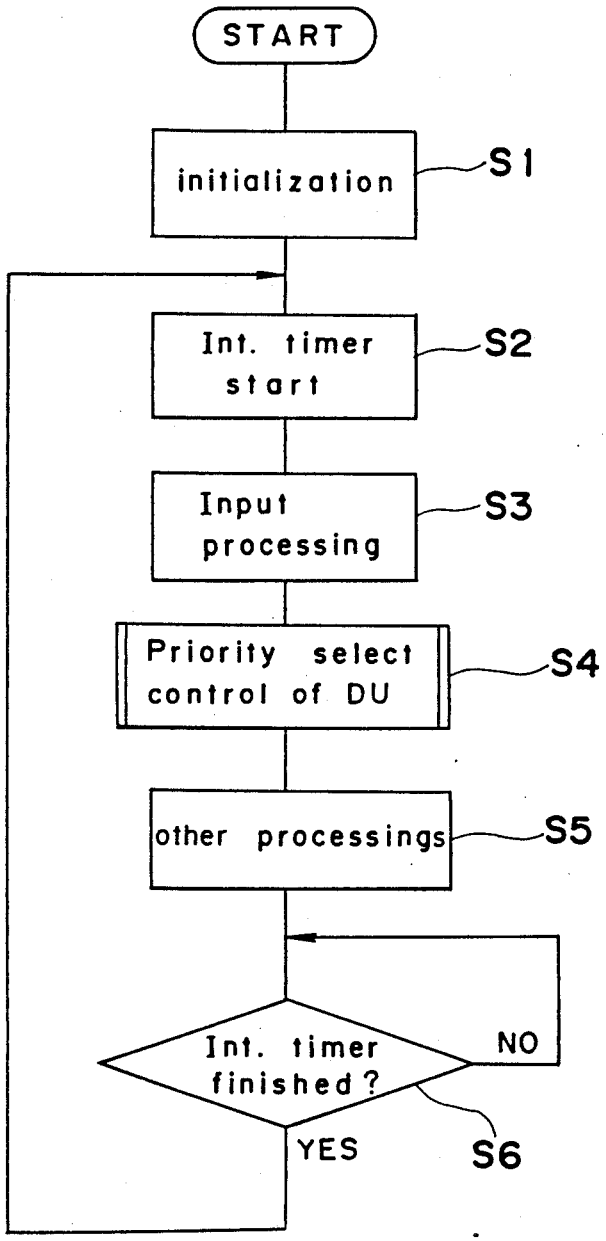
FIG. 7 is a flow chart of the main routine of the copy machine according to the present invention.

FIG. 7 shows a flow chart of the main routine to be executed by the first CPU 200. When the power switch PS is switched on, the main routine program is started at first and various registers and timers are initialized at step S1. Next, an internal timer which has been set initially is started at step S2. This internal timer is provided for making each processing time of individual subroutine even irrespective of contents of them.

Thereafter, various inputs from the operation panel 100 and output signals from individual sensors are accessed at step S3.

Next, a subroutine for priority selection control for the developing unit is called and executed at step S4. This subroutine will be stated later in detail since it is the subject matter of the present invention.

At step S5, a subroutine for output processings related to the copy operation is called and executed Then, it is checked at step S6 if the internal timer is finished or not and, if it is finished, the process returns to step S2.

Figure 1A:
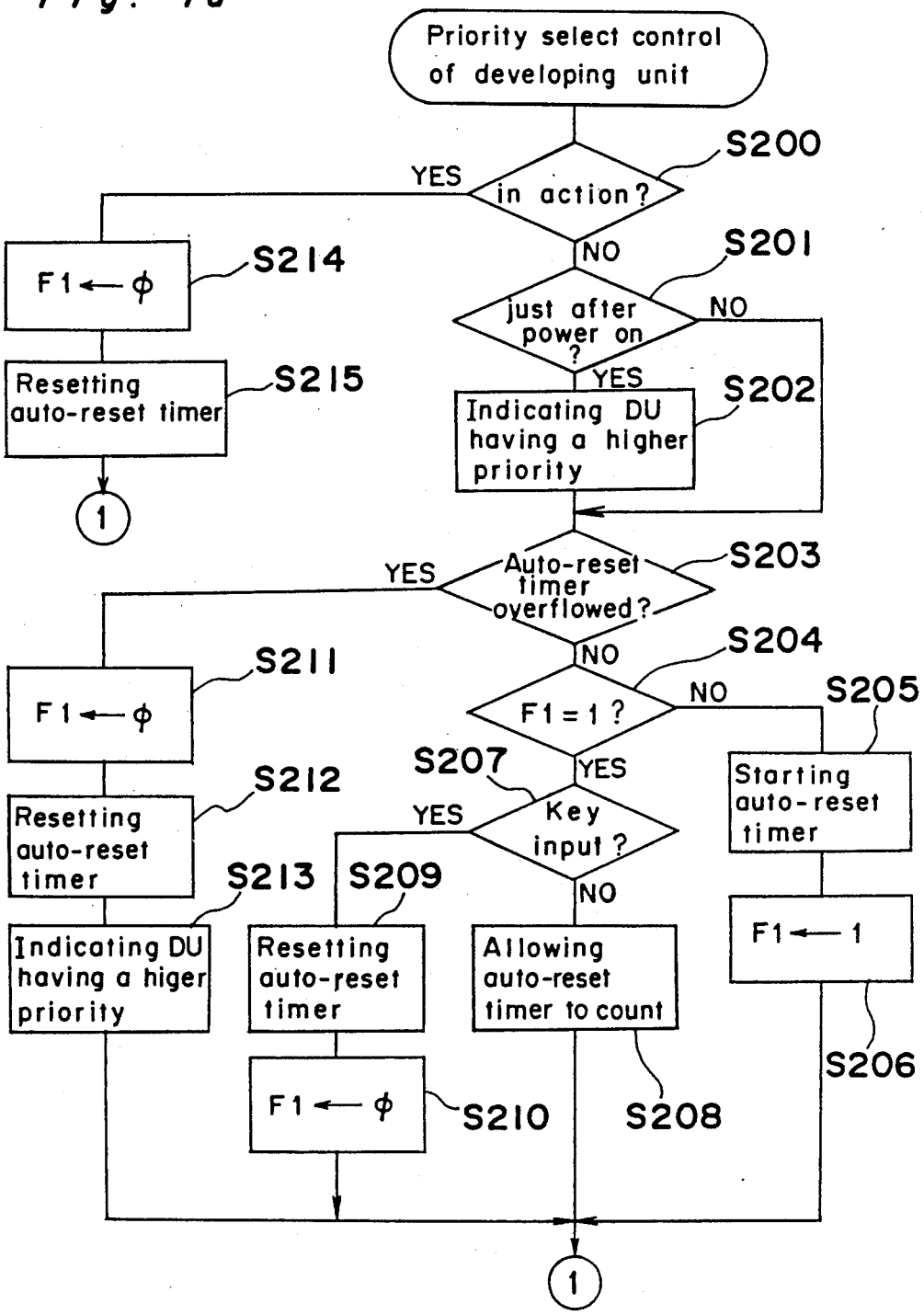
FIG. 1*a* FIG. 1*b* show a flow chart of a routine for selecting a developing unit according to the present invention.
Figure 1B:
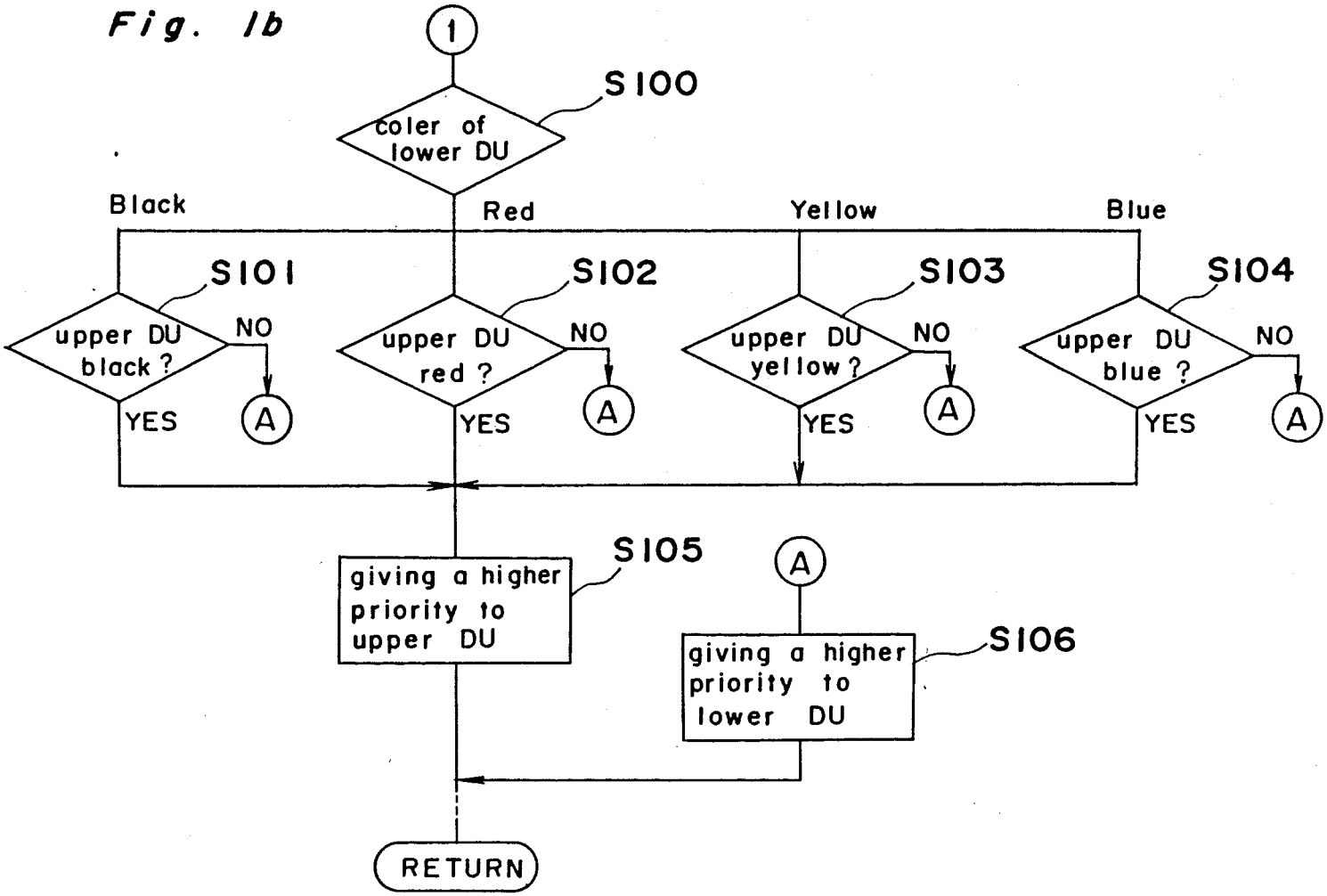

FIG. 1*a* and FIG. 1*b* show a flow chart of the subroutine for priority selection control of the developing unit.

Upon starting the explanation of the subroutine, it is to be noted that the color of toner of each of developing units having been set in the copy machine is identified in accordance with output signals from sensors 49, 50, 63 and 64.

At first, it is checked at step S200 whether or not the copy machine is in action to form an image of a document.

If it is NO at step S201, it is checked at step S201 whether or not the copy machine is in an initial state just after the power switch PS was switched on. If it is NO at step S201, the process is advanced to step S203. If it is YES, the process goes to step S202 to execute a processing for indicating or displaying a developing unit having a higher priority than the other. At step S203, it is checked whether or not a time set by so called auto-reset timer is over.

The auto-reset timer is started after completion of an image forming operation and, when it is overflowed, all displays on the operation panel 100 are initialized or reset to those in a predetermined priority mode. As is well known, the auto-reset operation is intended to avoid a miss copy by initializing the copy machine when a predetermined time is passed from the latest copy operation.

If it is NO at step S203, a flag F1 is checked at step S204. This flag Fl is a flag which sets when the auto-reset timer is started. Since it is "0" just after a copy operation, the process goes to step S205 to start the auto-reset timer. Then, the flag F1 is set at "1" at step S206 before advancing to step S100. If it is YES at step S204, the process goes to step S207 in order to check whether any key on the operation panel 100 is operated or not. If no key is operated, the process goes to step S208 to allow the auto-reset timer to count its time.

If either of keys is operated, the process goes to step S209 in order to reset the auto-reset timer and, then, the flag F1 is reset at "0" at S210. This is due to the reason that a copy preparation operation is assumed to be carried out by an operator when the key is operated. Namely, if the auto-reset timer is not reset, there is a possibility that the copy preparation operation is cancelled when the set time has been over.

If the auto-reset timer is overflowed at step S203, steps from S211 to S213 are executed in order to initialize indications on the operation panel 100. Namely, the flag F1 is reset at "0" at step S211, the auto-reset timer is reset at step S212 and the developing unit having a higher priority than the other is indicated or displayed on the operation panel 100 at step S213.

If the copy machine is in action at step S200, the flag F1 is reset at "0" at step S214 and, then, the auto-reset timer is reset at step S215 since it is not necessary to initialize indications on the operation panel 100. Thereafter, the process goes to step S100.

At step S100, the color of toner of the lower developing unit 6 which is given a higher priority than that of the upper one is identified in accordance with signals from the sensors 63 and 64. Then, the process goes to either one of steps from S101 to S104 in accordance with the color of toner identified at step S100.

If the color of toner of the lower developing unit 5 is identified to be black at step S100, it is checked whether the color of toner of the upper developing unit 5 is black or not at step S101.

If it is identified to be black at step S101, the upper developing unit 5 is given a higher priority than that of the lower one at step S105. In other words, the order of priority regarding the developing unit is changed from the normal state wherein the lower one is given a higher priority than the upper one.

Similarly, if the color of toner of the upper developing unit 5 is same to that of the lower one 6 at step S102, S103 or S104, the upper developing unit 5 is given a higher priority than that of the lower one 6.

On the other hand, if the color of toner of the upper developing unit 5 is identified not to be black at step S101, the process goes to step S106 and the lower developing unit 6 is given a higher priority than that of the upper one 5.

Similarly, as far as the color of toner of the upper developing unit 5 is different from that of the lower one 6, the lower one 6 is given a higher priority than that of the upper one 5.

Thus, if the color of toner of the upper developing unit 5 is different from that of the lower one 6, the lower developing unit 6 is given a higher priority so that it is selected as usual in the initial state of the copy machine or when the copy machine is reset by the auto-reset timer.

However, if a developing unit containing a color of toner same as that of the lower developing unit 6 is set as the upper developing unit 5, the upper one 5 is selected in the initial state or when the copy machine is reset into the initial mode by the auto-reset timer.

Accordingly, the frequency in use of the developing unit being given the top priority in the normal mode is decreased and the number of times of exchanging toner bottles is reduced with respect thereto.

Although only two developing units are disclosed in the present preferred embodiment, the present invention can be also applied to an image forming apparatus having three or more developing units.

Further, the present invention is applicable to various image forming apparatus other than a copy machine.

The preferred embodiments described herein are illustrative and not restrictive, the scope of the invention being indicated by the appended claims and all variations which come within the meanings of the claims are intended to be embraced herein.

What is claimed is:

1. An image forming apparatus comprising:

a photoconductor, first developing means for developing a latent image formed on the photoconductor with first developer, second developing means for developing a latent image formed on the photoconductor with second developer and selection means for selecting said first developing means if both of the first and second developers are alike and selecting said second developing means if the first developer and the second one are different from each other when a power supply source for the image forming apparatus is switched on.

2. An image forming apparatus according to claim 1 wherein color of the second developer is black.

3. An image forming apparatus according to claim 1 further comprising means for identifying individual colors of the first and second developers.

4. An image forming apparatus comprising:

a photoconductor, first developing means for developing a latent image formed on the photoconductor with first developer, second developing means for developing a latent image formed on the photoconductor with second developer and selection means for selecting said first developing means if both of the first and second developers are alike and selecting said second developing means if the first developer and the second one are different from each other when an image forming operation has been completed.

5. An image forming apparatus according to claim 4 wherein color of the second developer is black.

6. An image forming apparatus according to claim 4 further comprising means for identifying individual colors of the first and second developers.

7. An image forming apparatus comprising:

a photoconductor, first developing means for developing a latent image formed on the photoconductor with first developer, second developing means for developing a latent image formed on the photoconductor with second developer, entry means for entering conditions for forming an image and selection means for selecting said first developing means if both of the first and second developers are alike and selecting said second developing means if the first developer and the second one are different from each other when no image forming operation is started within a predetermined time period after said conditions for forming an image were entered.

8. An image forming apparatus according to claim 7 wherein color of the second developer is black.

9. An image forming apparatus according to claim 7 further comprising means for identifying individual colors of the first and second developers.

10. An image forming apparatus according to claim 7 wherein said entry means is key entry means.

11. An image forming apparatus according to claim 7 further comprising an auto-reset timer means for resetting the image forming apparatus into an initial mode thereof when no image operation is carried out within a predetermined time period.

12. In an image forming apparatus which includes a first developing means having first developer, second developing means having a second developer, designating means for designating one of said first and second developing means as a preferential developing means and preferential selecting means for selecting said preferential developing means at a predetermined timing, a method comprising the steps of:

recognizing kinds of said first and second developer;

comparing the kind of said first developer with the kind of the second developer;

designating the first developing means as the preferential developing means when the kind of said first developer is identical to the kind of said second developer; and designating said second developing means as the preferential developing means when the kind of said first developer is different from the kind of said second developer.

13. An image forming apparatus comprising:

first developing means having first developer;

second developing means having a second developer;

means for recognizing kinds of said first and second developer;

means for comparing the kind of said first developer with the kind of the second developer;

means for designating the first developing means as a preferential developing means when the kind of said first developer is identical to the kind of said second developer and for designating said second developing means as a preferential developing means when the kind of said first developer is different from the kind of said second developer; and selecting said preferential developing means at a predetermined time.

* * * * *